United States Patent [19]

Holleran

[11] Patent Number: 4,667,855

[45] Date of Patent: May 26, 1987

[54] METHOD OF REDUCING FAILURE OF PRESSURIZED CONTAINER VALVES

[75] Inventor: Peter M. Holleran, Orinda, Calif.

[73] Assignee: W. R. Grace & Co., Cambridge, Mass.

[21] Appl. No.: 210,204

[22] Filed: Nov. 25, 1980

[51] Int. Cl.[4] ..... B65B 31/00

[52] U.S. Cl. ..... 222/152; 222/402.1; 53/403; 53/432; 53/470; 141/3; 141/20

[58] Field of Search ..... 222/152, 190; 141/3, 141/9, 20, 70; 53/403, 432, 470, 510, 79

[56] References Cited

U.S. PATENT DOCUMENTS

| | | | |
|---|---|---|---|
| 2,723,200 | 11/1955 | Pyenson | 141/9 |
| 2,752,083 | 6/1956 | Ullman et al. | 226/68 |
| 2,820,489 | 1/1958 | Day et al. | 141/7 |
| 3,387,425 | 6/1968 | Flanner | 53/22 |
| 3,545,162 | 12/1970 | Clapp | 53/432 |
| 3,653,414 | 4/1972 | Weider | 141/4 |
| 3,908,869 | 9/1975 | Little | 222/148 |
| 4,146,066 | 3/1979 | Dietrich et al. | 141/9 |

OTHER PUBLICATIONS

Kirk Othmer, "Encyclopedia of Chemical Technology", 3rd Edition, vol. 3 (1978), pp. 582–587.

*Primary Examiner*—Joseph J. Rolla
*Assistant Examiner*—Frederick R. Handren
*Attorney, Agent, or Firm*—John J. Wasatonic; William L. Baker

[57] ABSTRACT

Valves connected to dip tubes in conventional pressurized "aerosol"-type containers for dispensing materials which react or cure upon dispensing (e.g. moisture-curable polyurethanes), are protected against premature failure by introducing a small amount of dry, inert gas into the dip-tube shortly after charging the container. The gas (e.g. nitrogen) acts as a barrier to prevent contact between the product in the container and the valve mechanism prior to use of the product. Preventing such contact avoids premature hardening of product in the valve mechanism caused by reaction of product with moisture.

13 Claims, 1 Drawing Figure

METHOD OF REDUCING FAILURE OF PRESSURIZED CONTAINER VALVES

BACKGROUND OF THE INVENTION

Many products today are conveniently packaged in and dispensed from pressurized "aerosol"-type containers. Aerosol packages typically are made up of (a) the product to be dispensed, (b) the propellant system, and (c) the container, valve, actuator and other accessories (the "hardware").

Conventional propellants used in aerosols include either liquified gases or compressed gases. The liquified gases fall into two chemical categories: (a) halocarbons (fluorocarbons, and chlorinated hydrocarbons); and (b) hydrocarbons (Kirk-Othmer, "Encyclopedia of Chemical Technology", Volume 3, Third Edition, (1978) page 586). An often used halocarbon is "fluorocarbon-12" such as "Freon 12®, dichlorodifluoromethane. The hydrocarbon propellants used are liquified petroleum gases such as propane, butane and isobutane. The chief advantage of liquifiable propellants is that they maintain a constant pressure in the aerosol container until the contents are exhausted.

Compressed gas propellants typically used in aerosol packages include carbon dioxide ($CO_2$), nitrous oxide ($N_2O$) and nitrogen ($N_2$). Such gases are not in a liquid state in conventional aerosol containers. They are non-toxic, nonflammable, low in cost and very inert. However, the vapor pressure in containers which utilize these propellants drops as the container is depleted, possibly causing changes in the rate and characteristics of the spray.

The conventional "hardware" used in aerosol packages includes pressure containers such as steel or aluminum cans usually having a dome-shaped top provided with a circular opening finished to receive a valve. The valve is usually spring-loaded and is situated inside the can. The valve has an upper tube or "stem" extending outside of the dome top for connection to an actuator device which may also function to direct the flow of product from the stem. To allow dispensing of the product from the aerosol container while the container is in an upright position, the valve in many aerosol cans is connected at its lower end to a vertical, hollow "dip-tube". The dip-tube extends into the product and upon actuation of the valve, product is forced by the propellant up the dip-tube and out through the valve. Without the dip-tube, the aerosol can would dispense product only by inverting the container, a manuever which displaces the vapor normally surrounding the valve with product.

The ability to dispense product while the aerosol container is in an upright, vertical position is a very desirable practical advantage in the dispensing of many products. For example, aerosol dispensed, "single-component" polymeric foam systems used to seal joints and spaces in buildings and the like, can be difficult or awkward to use if the container is required to be held in an other than upright position. One such single-component foamable product presently in use and which can be dispensed in an upright position, comprises essentially a mixture of isocyanate, polyol, and liquid halocarbon propellant such as "Freon 12"(which also functions as a "blowing agent" to create a foam when the product is dispensed). The isocyanate and polyol react to form a "prepolymer" product in the container which is fluid when dispensed, but which cures soon thereafter into a non-fluid body of foam when in contact with atmospheric moisture. The product is packaged in an aerosol can of conventiona design having a valve, valve stem and dip-tube. Such product, while being conveniently dispensable in an upright position, sometimes is found to be unable to be dispensed by the user after packaging and delivery of the product and prior to its first use.

BRIEF SUMMARY OF THE INVENTION

Examination of the aforementioned products led to the finding that the internal valve mechanisms were subject to becoming clogged by hardened product after packaging and before first use of the product. Investigations showed that the prepolymer product mixture proceeded up the dip tube and into contact with the valve mechanism after only a short period of time following charging of the propellants. It was theorized that the prepolymer mixture cured or hardened inside the valve mechanism when it came into contact with ambient moisture which permeated through the valve gaskets. This premature clogging of the valve can be prevented, it was discovered, by introducing a small amount of substantially dry, inert, gas into the dip-tube shortly after charging of the product mixture into the container. The gas acts as a physical barrier to prevent contact between the isocyanate-polyol mixture and the valve prior to first use of the product.

DETAILED DESCRIPTION OF THE INVENTION

Figure 1:
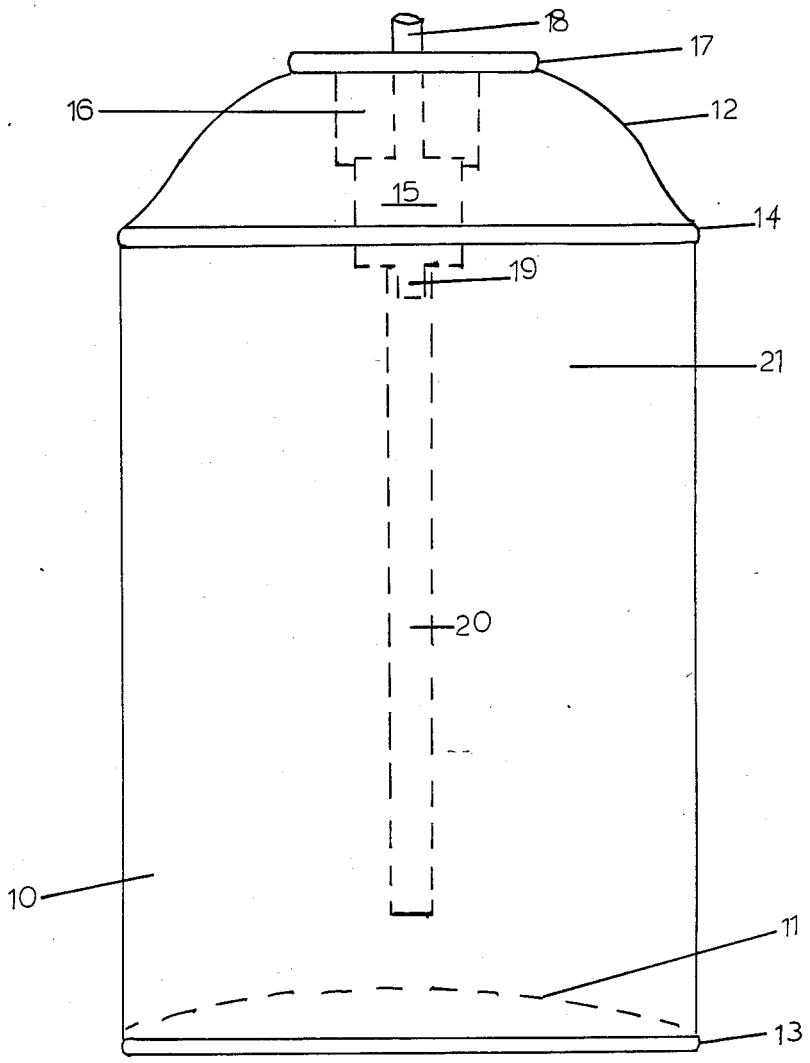
FIG. 1 is a view of one type of a conventional pressurized aerosol can showing the usual positioning of an internal valve and dip-tube mechanism. In the drawing, the can has been partially "cut-away" to expose the valve and dip-tube mechanisms.

In FIG. 1 there is shown a conventional pressurized "aerosol-type" metallic can having a generally cylindrical body 10, which has a concave bottom panel 11 joined to body 10 by a double seam at 13. Dome top 12 is attached to body 10 at 14 by a double seam also. Other conventional cans are also used such as those having no bottom seam or no top seam. A plastic valve means 15 is positioned and stationed within the can by way of a metal mounting cup 16 which is joined to the top of dome 12 by crimping at 17. Valve means 15 has a lower tubular inlet 19 to which is attached dip-tube 20.

Internal of valve 15, and located between stem 18 and inlet 19 is a spring and gasket arrangement (not shown) which may be any of the conventional arrangements for use with single-component polyurethane foams. The valve mechanism forms no part of the present invention and accordingly no details of such are shown. The valve mechanism is such that when stem 18 is depressed or deflected, liquid product mixture 21 is allowed to pass from dip-tube 20 into valve 15 and up and out of stem 18. Release of the pressure upon stem 18, which is spring-biased, causes the valve to close and thus cease flow of product 21.

As discussed above, an aerosol package of the type shown in the drawing and containing a moisture-curable "single-component" polyurethane foam formulation was sometimes found to become inoperative before even its first use. The cause was discovered to be clogging of the valve mechanism 15 internally in the area between inlet 19 and stem 18 by moisture-cured product, such that the stem 18 could not be depressed, or could not be released once depressed. The clogged containers had been prepared by sequentially introducing into the can (a) the isocyanate component, (b) the polyol (and other chemicals) component, followed by sealing of the can by insertion of the valve 15 to which had first been attached cup 16 and dip-tube 20. The sealing was obtained by crimping the edge of cup 16 at 17. The cans were then pressurized by introducing liquid haloalkane (fluorocarbon 12) into the sealed container through valve 15.

Experiments showed that liquid haloalklane introduced as above tended to settle out of the dip-tube soon after its introduction to the container through the valve (about one minute or less). The settling is believed due to the greater density of the haloalkane as compared to the isocyanate-polyol mixture. The settled haloalkane is replaced in the dip tube by product mixture 21. Increase in pressure within the can caused by the exothermic reaction between the isocyanate and polyol components is believed to force product mixture 21 into the valve mechanism 15. Any moisture already in or finding its way into valve 15 during subsequent packaging, shipping and storage causes the component mixture in the valve to cure and harden, leading to the abovementioned premature valve clogging.

According to the invention herein, the aforedescribed entry of the isocyanate-polyol product mixture into the valve mechanism is prevented by injecting a small amount of dry, inert gas through the valve mechanism and into the dip-tube shortly after charging of the haloalkane propellant-blowing agent to the container. The gas acts as a physical barrier to prevent product 21 from being forced into the valve mechanism 15.

At least a sufficient amount of the inert gas must be injected to act under the conditions in the container to prevent the product from entering valve 15. Preferably, enough gas is added which will fill substantially the entire dip-tube. Because the gas is lighter than the remaining components in the container, the gas will remain in position in the dip-tube between the product and the valve. Upon first use of the product, the inert gas "barrier" is exited from the container allowing normal dispensing of product.

The amount of inert gas added in accordance with the invention can exceed that required to fill the dip-tube, but care should be exercised to avoid over-pressurization of the container. The function of the inert gas component in the present invention is to prevent contact between product and valve, and not as a propellant for product in the container.

Investigations conducted with the aforedescribed "single component" foamable polyurethane product packaged in either 12 or 14 ounce sized aerosol cans of the type shown in the drawings showed the following: (1) The exothermic reaction between essentially the isocyanate and polyol ingredients reaches a peak of from 110° to 120° F. within 30 to 60 minutes after introduction to the container. The inert gas component should be added prior to the peak temperature, that is, less than 30 to 60 minutes; (2) Visual observations in clear aerosol containers showed that product migrated up the dip-tube to reach the valve in 10 seconds. Thus, to avoid valve contamination completely, the inert gas must be added in less than 10 seconds after the liquified gas propellant has been charged; (3) The amount of inert gas added to container is critical-less than 5 $cm^3$ would be inadequate to remove all chemical from the dip-tube; too much would increase total pressure beyond safe limits (add only maximum of 10 psig); (4) The pressure of inert gas during addition must be higher than internal pressure of the container; (5) The inert gas must be one which has a low "Ostwald Solubility Coefficient" for the chemical formulation. Coefficients greater than 0.5 are less acceptable since they will be dissolved in the aforedescribed formulation over a period of time. Ostwald Solubility Coefficient is defined in the article "Formulations With Soluble Gas Propellants" from *Aerosol Age,* December, 1964, by Howard Hsu and Donald Campbell. The coefficient defines the ratio of the volume of gas which will dissolve in a liquid to the total volume of liquid available.

The term "inert" as employed herein in connection with the gas used to prevent contact between the product and the valve is intended to indicate gases which show substantially no chemical activity when in contact with the other chemicals in the container. For example, should a gas be used which is sufficiently reactive with one or more of such chemicals, product could be allowed to reach the valve from the dip-tube and thus defeat the purpose of the inert gas barrier. A similarly undesirable result could occur were the gas one which is sufficiently dissolvable by, or is a sufficient solvent for, the other chemicals in the container.

In instances where as above the product to be dispensed is moisture-curable, the inert gas should also be substantially dry, that is, substantially free of moisture. Should sufficient moisture be present in the gas, the moisture-curable product could cure or harden in contact with the gas in the dip-tube to an extent that normal dispensing of the product is interfered with.

The preferred inert, substantially dry gases useable herein are those which are most economically available. Dry nitrogen is the most preferred inert gas for use in accordance with the invention. Dry air (4/5 nitrogen) may also be used, as can nitrous oxide and carbon dioxide. The latter two gases however are more soluble in isocyanate-polyol aerosol foam systems and are less desirable in connection with these systems for that reason.

The following example further illustrates the invention.

EXAMPLE

Several 14 ounce-sized aerosol cans of the type shown in the drawing were filled with identical "one-component" foamable polyurethane formulations of the aforedescribed type using the following procedure. The polyol, isocyanate and other "product" chemical components were first placed in the cans and the cans thereafter sealed by attachment of the valve, cup and dip-tube assembly. Each container was lastly pressurized by the addition of an identical amount of liquid fluorocarbon 12 propellant-blowing agent through the valve mechanism.

Once filled as above, some of the containers were then immediately injected with nitrogen (through the valve) at 110 psig from a prepressurized guage. Although the exact volume of the device was not calculated, it may be assumed that the value of nitrogen added was adequate to remove most of the liquid components from the dip-tube. Five nitrogen-injected products were compared with five non-injected products ("controls") in a test to determine the effectiveness of the nitrogen in preventing premature valve clogging. The products tested were stored at 90° F. and 90% relative humidity with no protective bagging or presence of dessicant. Each of the products was tested for ability to be dispensed after storage for 7, 14 and 28 days. In the products which were able to be dispensed, the rate of extrusion (grams per minute ) was measured. The results of the test are shown in Table I.

TABLE I

| SAMPLES | DISPENSIBILITY EXTRUSION RATE, GRAMS/MINUTE AFTER 7 DAYS | AFTER 14 DAYS | AFTER 28 DAYS |
|---|---|---|---|
| Control No. | | | |
| 1 | No dispense | No dispense | No dispense |
| 2 | No dispense | No dispense | No dispense |
| 3 | No dispense | No dispense | No dispense |
| 4 | No dispense | No dispense | No dispense |
| 5 | 29 | No dispense | No dispense |
| Nitrogen-Injected No. | | | |
| 1 | 33 | No dispense | 36 |
| 2 | 37 | 33 | 35 |
| 3 | 32 | 45 | 17 |
| 4 | 30 | 46 | 38 |
| 5 | 25 | 41 | — |

The results shown in Table I indicate that injection of nitrogen into the aerosol dip-tube following filling of the container with product is a successful technique for prevention of premature valve failure. Most "control" samples were not able to be dispensed after only seven days storage at 90° F. and 90% relative humidity.

It is claimed:

1. An improved article of the aerosol type comprising a pressurized container comprising a mosture curable product to be dispensed, a liquified gas propellant, valve means associated with a dip tube for dispensing said product, and a sufficient amount of inert gas positioned in said dip tube between said product and said valve means to act as a barrier to prevent migration of said product to said valve means during shipment and storage of said article.

2. The improved article of claim 1 wherein said product is a moisture-curable product obtained by reacting essentially isocyanate and polyol.

3. The improved article of claim 1 or 2 wherein said liquified gas propellant is a haloalkane.

4. The improved article of claim 1 wherein said inert gas in substantially dry.

5. The improved article of claim 1 wherein said gas substantially fills said dip-tube.

6. An improved method of preparing containers of the pressurized aerosol type containing moisture-curable product, said method comprising the steps of placing said product in a container, sealing said container by installing thereon sealing means comprising valve means connected to a dip tube for dispensing said product, introducing a liquified haloalkane propellant through said valve means, and introducing a sufficient amount of substantially dry inert gas into said dip tube of said sealed container through said valve means after introduction of said product and haloalkane to prevent migration of said product from said dip tube into said valve means, whereby reaction between said product and moisture in said valve means is prevented during shipment and storage of said container.

7. The improved method of claim 6 wherein said inert gas is nitrogen, air, carbon dioxide, nitrous oxide, or mixture of such.

8. The improved method of claim 6 wherein said product is a foamable mixture containing essentially isocyanate and polyol.

9. The improved method of claim 8 wherein said inert gas is introduced within less than 30 to 60 minutes following introduction of said isocyanate and polyol into said container, and in less than 10 seconds following said haloalkane.

10. The improved method of claims 7, 8 or 9 wherein less than 5 cubic centimeters of said inert gas are introduced.

11. The improved method of claim 6 wherein the pressure of said inert gas during introduction is higher than the internal pressure of said container.

12. The improved method of claim 8 wherein said gas has an Ostwald Solubility Coefficient less than 0.5.

13. The article or method of claims 1 or 6 wherein said propellant is dichlorodifluoromethane.

* * * * *